US005353725A

United States Patent [19]

Sakakibara

[11] Patent Number: 5,353,725

[45] Date of Patent: Oct. 11, 1994

[54] FRONT AND REAR EMBROIDERY FRAME MOUNTING MEMBERS

[75] Inventor: Hisato Sakakibara, Ichinomiya, Japan

[73] Assignee: Kabushikikaisha Barudan, Ichinomiya, Japan

[21] Appl. No.: 970,134

[22] Filed: Nov. 2, 1992

[30] Foreign Application Priority Data

Nov. 7, 1991 [JP] Japan ..... 3-321210
Feb. 26, 1992 [JP] Japan ..... 4-076344

[51] Int. Cl.[5] ..... D05C 9/04
[52] U.S. Cl. ..... 112/103; 112/121.15
[58] Field of Search ..... 112/103, 86, 90, 102, 112/121.12, 121.15; 38/102.2, 102.91; 160/380

[56] References Cited

U.S. PATENT DOCUMENTS 4,280,420 7/1981 Nishida et al. ..... 112/86 X
4,762,076 8/1988 Wakaizumi ..... 112/103
4,834,006 5/1989 Goto ..... 112/103
4,993,333 2/1991 Moore, III ..... 112/103

FOREIGN PATENT DOCUMENTS 3604725 7/1987 Fed. Rep. of Germany ... 38/102.91
63-81890 5/1988 Japan .
63-182465 7/1988 Japan .
1260052 10/1989 Japan .
2216253 8/1990 Japan .
3130456 6/1991 Japan .

*Primary Examiner*—Clifford D. Crowder
*Assistant Examiner*—Ismael Izaguirre
*Attorney, Agent, or Firm*—Cushman Darby & Cushman

[57] ABSTRACT

An embroidery frame mounting device is provided for an embroidering machine. The mounting device comprises: a rear mounting member for mounting the rear portion of an embroidery frame on a frame, which is disposed on a table of the embroidering machine; and a front mounting member for mounting the front portion of the embroidery frame on the same frame. The rear mounting member is constructed to include a rear bracket mounted on the embroidery frame, a rear positioning unit for positioning the rear bracket transversely with respect to the frame, and a spring for urging and holding the rear bracket on the frame. The front mounting member is constructed to include a front bracket mounted on the embroidery frame, a front positioning unit for positioning the front bracket longitudinally and transversely with respect to the frame, and a magnet for attracting and holding the front bracket on the frame.

13 Claims, 8 Drawing Sheets

FRONT AND REAR EMBROIDERY FRAME MOUNTING MEMBERS

BACKGROUND OF THE INVENTION

1. Field of the Invention

The present invention relates to an embroidery frame mounting device for removably mounting an embroidery frame set with tensed cloth on a frame which is disposed on a table of an embroidering machine and, more particularly to an improvement in a device for mounting the embroidery frame at its two front and rear portions.

2. Description of the Prior Art

As an embroidery frame mounting device of this kind, there are known technologies, as disclosed in Japanese Patent Laid-Open Nos. 260052/1989 and 216253/1990, for example. In the former device, the embroidery frame is fixed at its two front and rear portions on the frame by means of screws. In the latter device, a bracket mounted on the rear portion of the embroidery frame is inserted from the front onto a stepped pin of the frame, and a snap pin anchored on the front portion of the embroidery frame is fitted downward into a snap hole of the frame.

However, the former device of the prior art has a problem that the handling of the screws is troublesome to take a considerable time for replacing the embroidery frame. On the other hand, due to the widening of the gap for inserting the bracket onto the stepped pin and the fitting of the snap pin in the snap hole, the front and rear portions of the embroidery frame are liable to have some play so that the latter device has a problem in the deteriorated positioning precision.

SUMMARY OF THE INVENTION

Therefore, an object of the present invention is to provide an embroidery frame mounting device which can mount an embroidery frame on said frame precisely by a simple action.

According to an aspect of the present invention, there is provided an embroidery frame mounting device for an embroidering machine, which comprises: a rear mounting member for mounting the rear portion of an embroidery frame on a frame which is disposed on a table of the embroidering machine; and a front mounting member for mounting the front portion of said embroidery frame on the same frame, wherein said rear mounting member includes a rear bracket mounted on said embroidery frame, a rear positioning unit for positioning said rear bracket transversely with respect to said frame, and a spring for urging and holding said rear bracket on said frame, and wherein said front mounting member includes a front bracket mounted on said embroidery frame, a front positioning unit for positioning said front bracket longitudinally and transversely with respect to said frame, and a magnet for attracting and holding said front bracket on said frame.

BRIEF DESCRIPTION OF THE DRAWINGS

Other objects and features of the present invention will become apparent from the following description to be made with reference to the accompanying drawings, in which.

DESCRIPTION OF THE PREFERRED EMBODIMENTS

Figure 1:
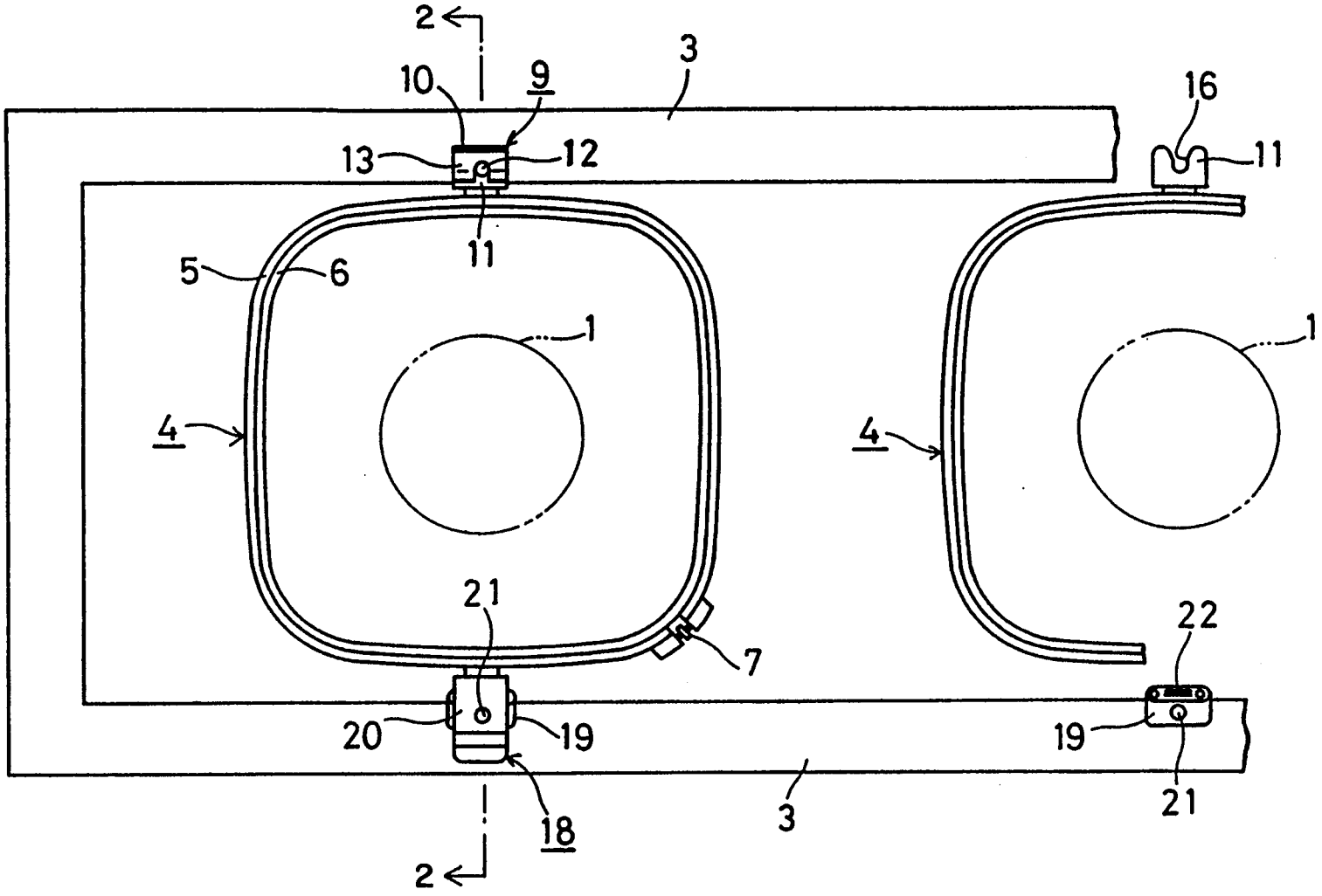
FIG. 1 is a top plan view showing an embroidery frame mounting device according to a first embodiment of the present invention.
Figure 2:
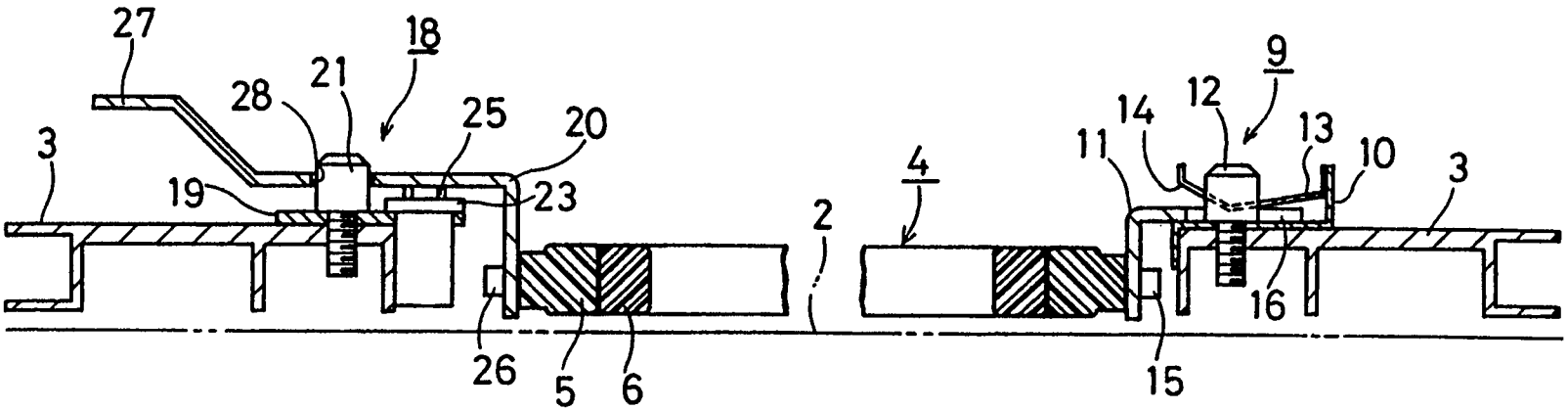
FIG. 2 is a section view taken along line 2—2 of FIG. 1.

Here, the rear positioning unit of the rear mounting member is constructed, for example, to include a pin projected from the upper face of the frame, and a notch formed in the rear bracket and adapted to be fitted on the pin from the front. Alternatively, to the contrary, the rear positioning unit can be exemplified by forming a notch in the frame and by projecting a pin from the rear bracket. The spring can be mounted on either the frame or the rear bracket.

The front positioning unit of the front mounting member is constructed, for example, to include a pin projected from the upper face of the frame and a hole formed in the front bracket and adapted to be fitted downward on the pin. Alternatively, to the contrary, the front positioning unit can be exemplified by forming a hole in the frame and by projecting a pin from the front bracket. The magnet can be mounted on either the frame or the front bracket. The magnet to be used may be not only a permanent magnet but also an electromagnet.

Especially in case a permanent magnet is used as the magnet, there may be preferably mounted on the front mounting member a manual actuation lever for removing the front bracket from the frame against the attraction of the permanent magnet. The manual actuation lever can be exemplified either by one for turning in a horizontal plane or by another for turning in a vertical plane.

When in the mounting operation of the embroidery frame mounting device of the present invention, the embroidery frame is moved backward to cause the rear bracket of the rear mounting member to be clamped on the frame by the spring, and the front portion of the embroidery frame is then lowered to allow the front bracket of the front mounting member to be attracted onto the frame by the magnet. For dismounting the embroidery frame, the front portion of the embroidery frame is lifted to remove the front bracket from the frame, and the embroidery frame is then moved forward to extract the rear bracket from the frame. Thus, the embroidery frame can be easily mounted on and dismounted from the frame merely by the simple action of moving it.

In the mounted state, moreover, the rear bracket is restricted on the frame in its transverse movement by the rear positioning unit and in its floating motion by the spring. At the same time, the front bracket is restricted on the frame in its longitudinal and transverse movements by the front positioning unit and in its floating motion by the magnet. As a result, the embroidery frame can be prevented in its entirety without fail from having its longitudinal, transverse and vertical play, to have its mounting precision improved.

If the front mounting member is equipped with the manual actuation lever, the front bracket can be easily removed from the frame by the lever action. Moreover, the mounting precision of the embroidery frame can be better improved by using a stronger permanent magnet.

A first embodiment embodying the present invention will be described in the following with reference to FIGS. 1 to 4.

A frame 3 is so mounted on a table 2 as to surround a plurality of heads 1. An embroidery frame 4 is equipped with an outer frame 5 and an inner frame 6 for tensing the (not-shown) cloth to be worked or embroidered. The outer frame 5 is equipped with an adjuster 7. Moreover, the embroidery frame 4 is removably mounted on the frame 3 by means of a rear mounting member and a front mounting member, as will be described hereinafter, and is moved back and forth and rightward and leftward by means of a (not-shown) carriage on the basis of predetermined embroidery pattern data. In accordance with these movements, the cloth of the embroidery frame 4 can be embroidered with the predetermined pattern.

Reference numeral 9 designates the rear mounting member for mounting the rear portion of the embroidery frame 4. This rear mounting member 9 is equipped, as shown at the righthand side of FIG. 2 and in FIG. 3, with a rear base 10 mounted on the frame 3 and a rear bracket 11 mounted on the embroidery frame 4.

The rear base 10 is formed by bending a metal sheet and is fixed on the upper face of the frame 3 by means of a threaded pin 12. On the rear end of the rear base 10, there is fixed a leaf spring 13 for urging and holding the rear bracket 11 on the rear base 10. This leaf spring 13 has its front free end sloped, as at 14, to receive the rear bracket 11. This rear bracket 11 is made of an L-shaped metal sheet and is mounted on the outer face of the outer frame 5 by means of a screw 15. The rear bracket 11 has its central portion notched, as at 16, to be fitted on the front of the threaded pin 12. These notch 16 and threaded pin 12 constitute together a rear positioning unit for positioning the rear bracket 11 transversely with respect to the rear base 10. Incidentally, the notch 16 has its rear end widened to be smoothly fitted on the threaded pin 12.

Numeral 18 designates the front mounting member for mounting the front portion of the embroidery frame 4 on the frame 3. This front mounting member 18 is equipped as shown at the lefthand side of FIG. 2 and in FIG. 4, with a front base 19 mounted on the frame 3 and a front bracket 20 mounted on the embroidery frame 4.

The front base 19 is fixed on the upper face of the frame 3 by means of a threaded pin 21, and a permanent magnet 22 is mounted on the rear portion of the front base 19 through a mounting plate 23 by means of screws 24. The permanent magnet 22 is equipped with attracting members 25 for attracting and holding the front bracket 20 on the front base 10. The front bracket 20 is formed by bending a magnetic sheet. This front bracket 20 has its rear end mounted on the outer face of the outer frame 5 and its front end equipped with a knob 27. The front bracket 20 is formed at its central portion with a hole 28, through which it is fitted on the threaded pin 21. These hole 28 and threaded pin 21 constitute together a front positioning unit for positioning the front bracket 20 longitudinally and transversely with respect to the front base 19. Incidentally, the threaded pin 21 has its top tapered to be smoothly fitted in the hole 28.

Figure 3:
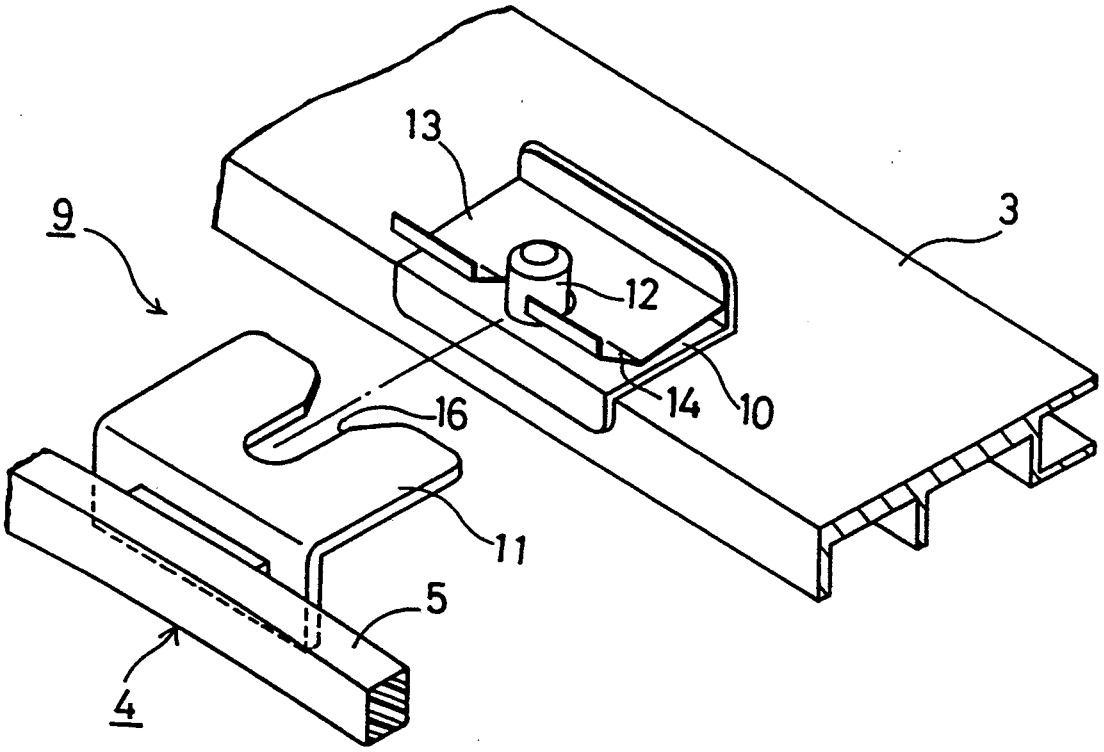
FIG. 3 is an exploded perspective view showing a rear mounting member.
Figure 4:
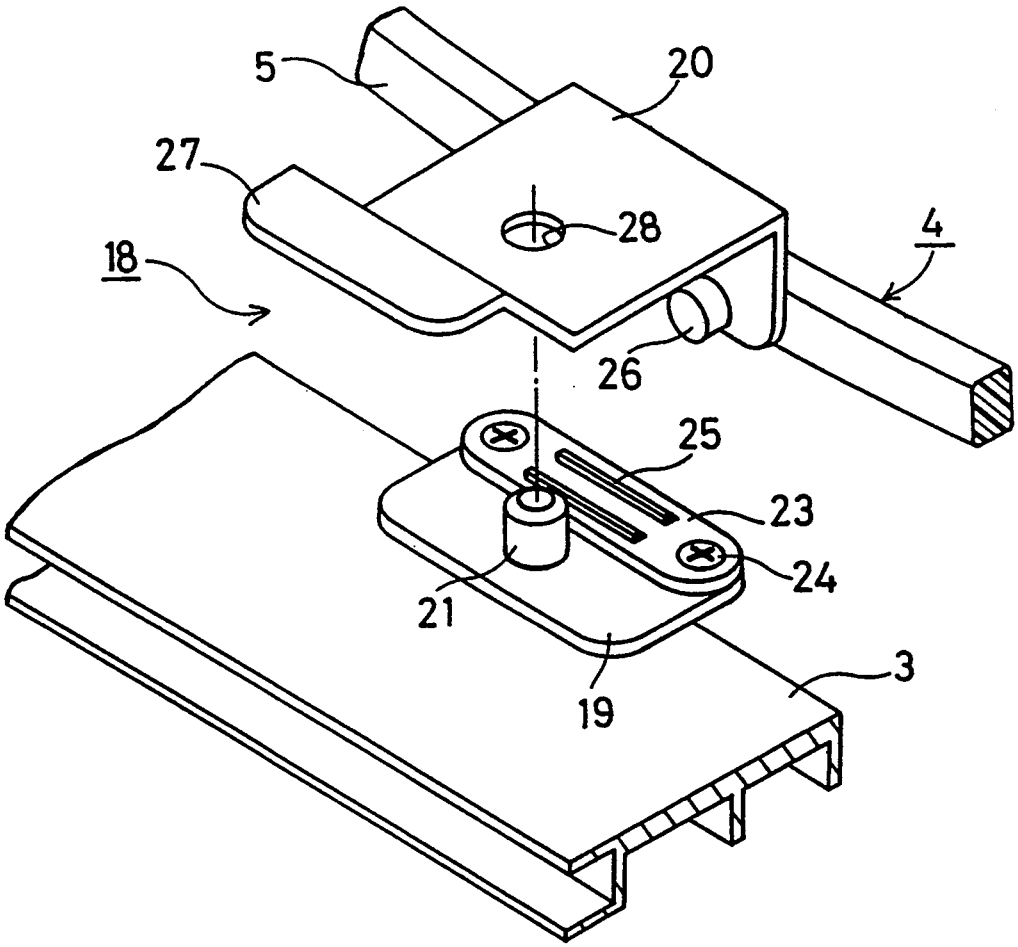
FIG. 4 is an exploded perspective view showing a front mounting member.

Next, the operations of the embroidery frame mounting device of the present embodiment will be described in the following. In case the embroidery frame 4 is to be mounted, it is moved backward at first with the notch 16 of the rear bracket 11 being directed toward the threaded pin 12, as shown in FIG. 3, until the rear bracket 11 is clamped and held on the rear base 10 by the leaf spring 13. Then, as shown in FIG. 4, the front portion of the embroidery frame 4 is lowered to fit the hole 28 of the front bracket 20 on the threaded pin 21 so that the front bracket 20 may be attracted to the front base 19 by the permanent magnet 22.

For dismounting, the front portion of the embroidery frame 4 is slightly lifted to remove the front bracket 20 from the front base 19, and the embroidery frame 4 is then moved forward to extract the rear bracket 11 from the rear base 10. Thus, the embroidery frame 4 can be easily mounted on and dismounted from the frame 3 by the simple action of moving the embroidery frame 4 merely back and forth. Incidentally, since the permanent magnet 22 is located to the side of an operator, the front bracket 20 can be detached by a light force from the permanent magnet 22.

In the mounted state, the rear bracket 11 is restricted on the rear base 10 in its transverse movements by the threaded pin 12 and in its floating motion by the leaf spring 13. On the other hand, the front bracket 20 is restricted on the front base 19 in its longitudinal and transverse movements by the threaded pin 21 and in its floating motion by the permanent magnet. As a result, the embroidery frame 4 can be prevented in its entirety without fail from its longitudinal, transverse and vertical play, to have its mounting precision improved. As a result, any shear will appear in the embroidered pattern even if the embroidery frame 4 is dismounted from a certain set pair of front and rear mounting members 9 and 18 and then mounted on another set pair of front and rear mounting members 9 and 18 so that its cloth is consecutively worked by a plurality of embroidering machines.

Figure 5:
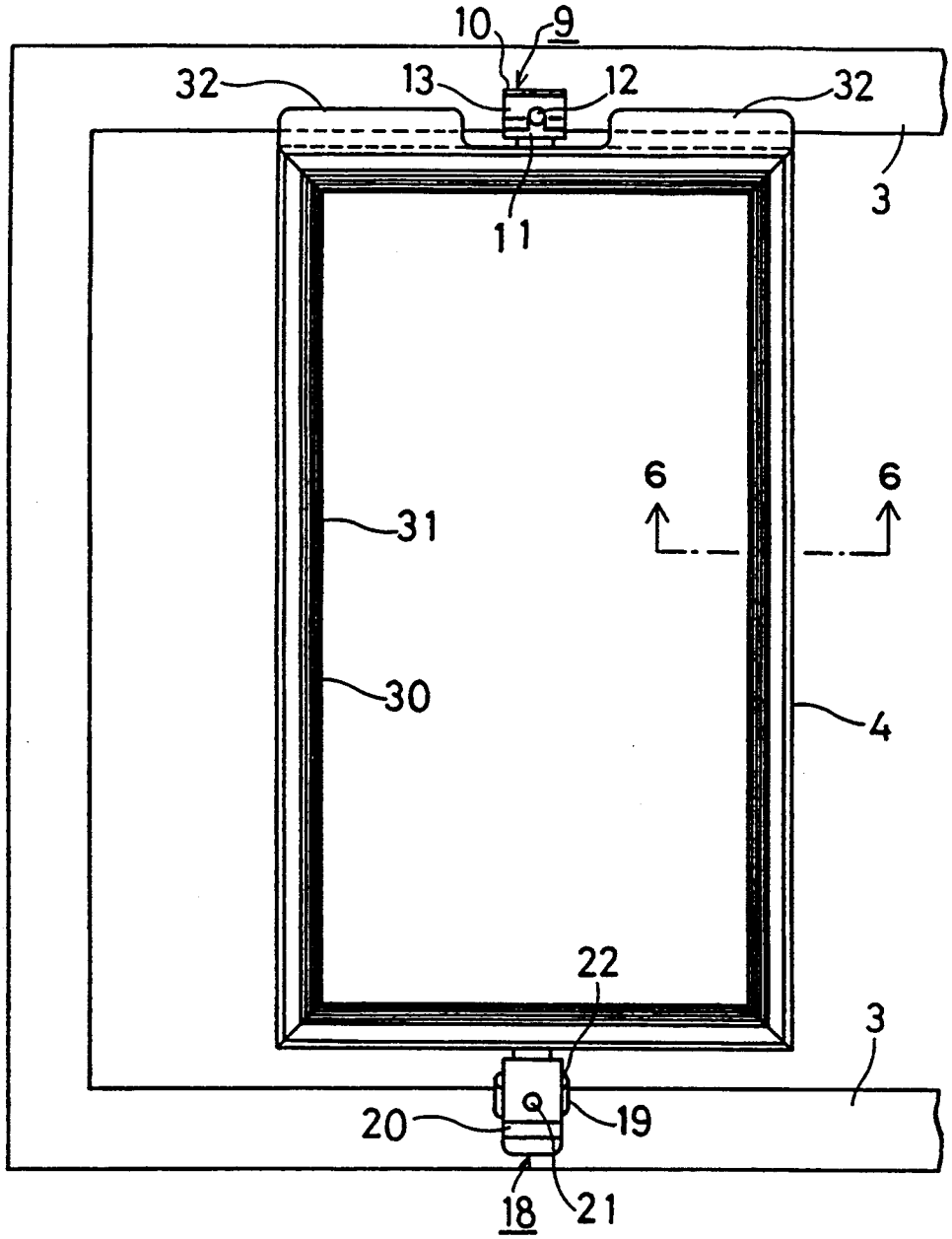
FIG. 5 is a top plan view showing an embroidery frame mounting device according to a second embodiment of the present invention.
Figure 6:
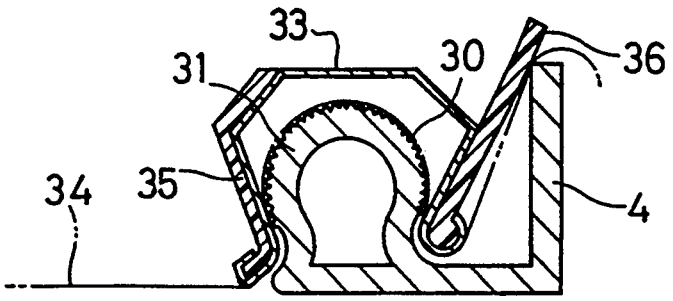
FIG. 6 is a section view taken along line 6—6 of FIG. 5.

FIGS. 5 and 6 show a second embodiment of the present invention. Here is provided the embroidery frame mounting device for an embroidery frame 4 having a large size (e.g., an inner size of 500 mm × 800 mm). As shown in FIG. 5, the embroidery frame 4 is formed into a rectangle having an annular cloth holder 31 of pipe section, which is equipped with a non-slip frame 30 on its inner peripheral edge. At the rear end edge of the embroidery frame 4, there are projected ears 32 which are located at the two sides of the rear mounting member 9, to prevent the embroidery frame 4 from being vertically inclined. As shown in FIG. 6, moreover, a cover frame 33 is fitted on the cloth holder 31 to clamp cloth 34 to be worked in between. Reference numeral 35 designates a reinforcing member for reinforcing the cover frame 33, and numeral 36 designates an expanding member for expanding the cover frame 33 by a lever action.

The construction for and method of mounting the embroidery frame 4 are similar to those of the foregoing embodiment. In this second embodiment, too, the embroidery frame 4 can be mounted on the frame 3 precisely by the simple operation. The detail of the embroidery frame 4 and the cover frame 33 should be referred to Japanese Patent Laid-Open No. 182465/1988.

Figure 7:
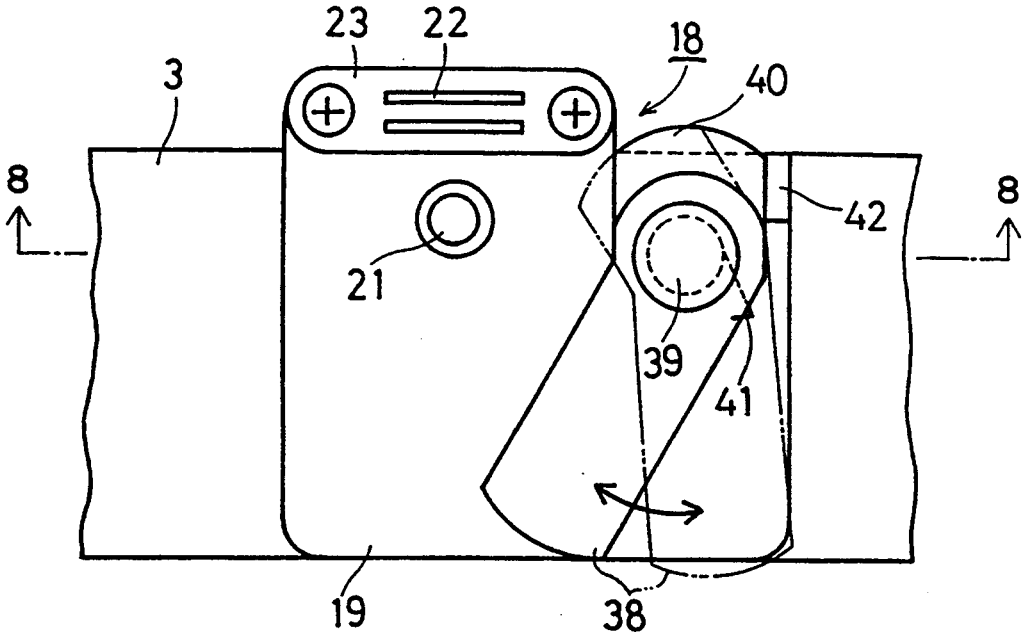
FIG. 7 is a top plan view showing a front mounting member equipped with a manual actuation lever according to a third embodiment of the present invention.
Figure 8:
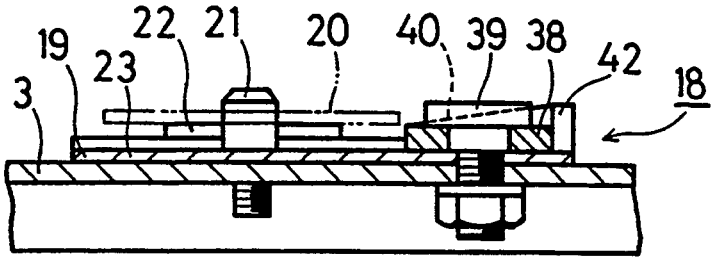
FIG. 8 is a section view taken along line 8—8 of FIG. 7.
Figure 9:
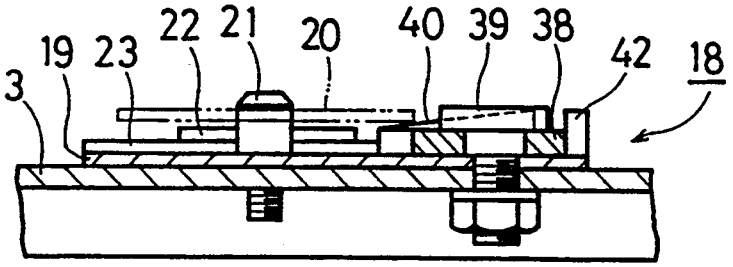
FIG. 9 is a section view showing an operating state different from that of FIG. 8.

FIGS. 7 to 9 show a third embodiment of the present invention. In this third embodiment, the front mounting member 18 is equipped with a manual actuation lever 38 for removing the front bracket 20 from the front base 19 against the attraction of the permanent magnet 22. The manual actuation lever 38 is so mounted on the frame 3 by means of a stepped pin 39 as to turn in a horizontal plane and has its rear end upper face with a sloped cam surface 40. This stepped pin 39 is equipped with a spring 41 for urging the manual actuation lever 38 clockwise of FIG. 7. At the same time, the front base 19 is equipped with a stopper 42 which is projected therefrom for stopping the manual actuation lever 38 in a position, as indicated by solid lines in FIG. 7.

In the stopped state of the actuation lever 38, moreover, the cam surface 40 is located apart from the side of the front bracket 20, as shown in FIG. 8. When the manual actuation lever 38 is manually turned to the position, as indicated by broken lines in FIG. 7, the cam surface 40 is forced into the clearance between the front base 19 and the front bracket 20, as shown in FIG. 9, so that the front bracket 20 is separated upward from the permanent magnet 22. As a result, the front bracket 20 can be easily dismounted from the front base 19 by the light actuating force given by the lever action of the manual actuation lever 38. Moreover, the mounting precision of the embroidery frame 4 can be better improved by using the stronger permanent magnet 22.

Figure 10:
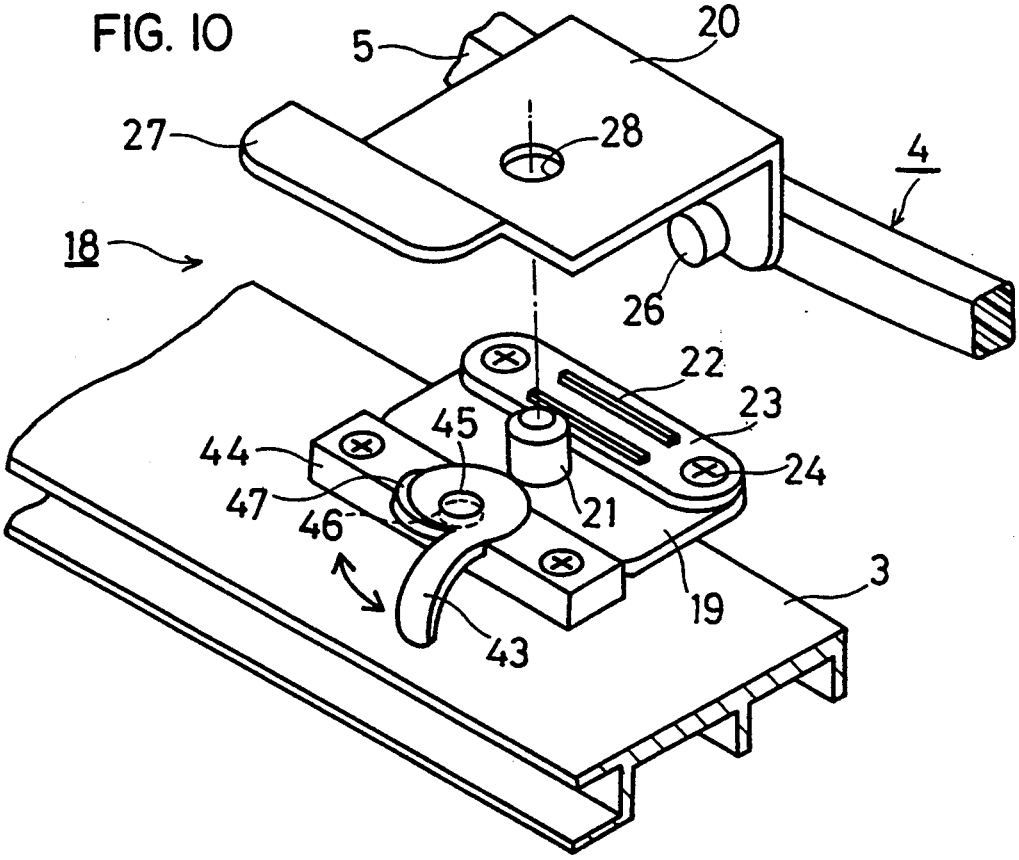
FIG. 10 is a perspective view of a front mounting member and shows a modification of the manual actuation lever.

FIG. 10 shows a modification of the manual actuation lever. In this modification, the manual actuation lever, as designated at 43, is so supported on the frame 3 through a mounting bed 44 by a pivot pin 45 as to turn in a horizontal plane and is urged counter-clockwise of FIG. 10 by a spring 46. The manual actuation lever 43 is formed on its root with a cam surface 47 which is projected from the peripheral edge of the root. When the manual actuation lever 43 is turned clockwise of FIG. 10, the cam surface 47 is forced into the clearance between the front base 19 and the front bracket 20 so that the front bracket 20 is separated upward from the permanent magnet 22.

Figure 11:
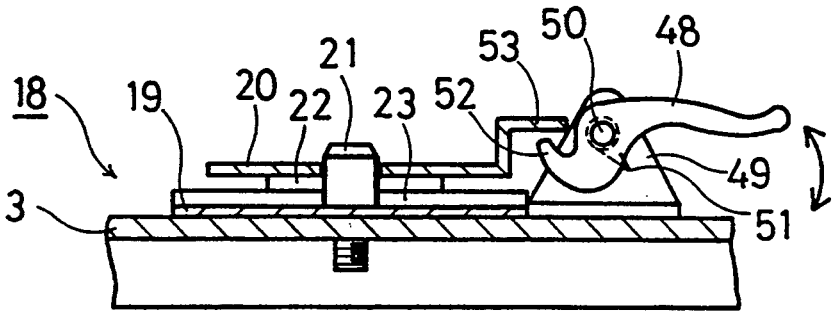
FIG. 11 is a section view of a front mounting member and shows another modification of the manual actuation lever.
Figure 12:
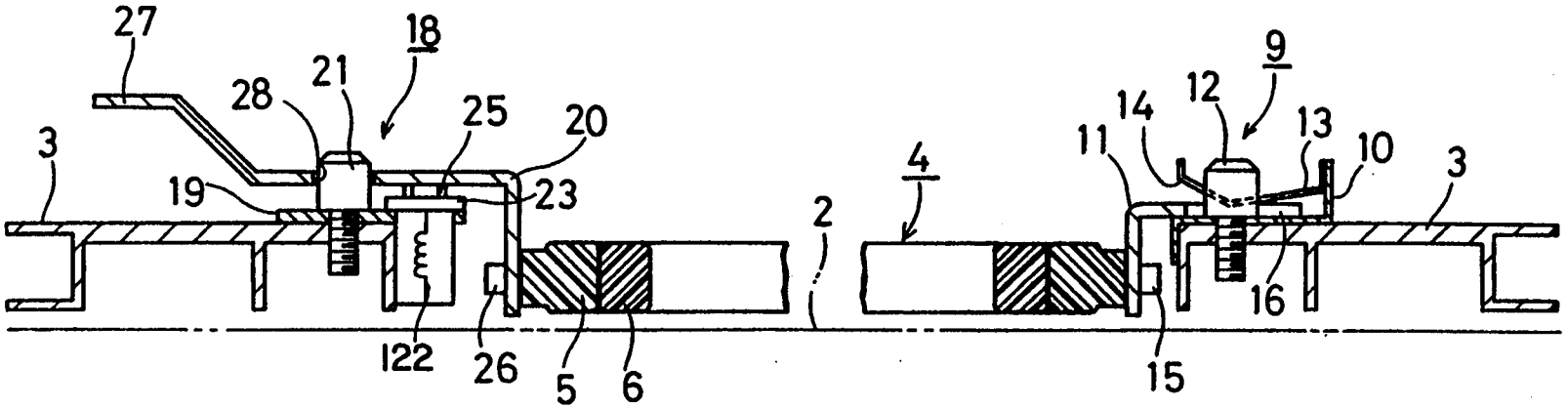
FIG. 12 is a sectional view taken along the line 2—2 of FIG. 1 showing an electromagnet.

FIG. 11 shows another modification of the manual actuation lever. In this modification, the manual actuation lever, as designated at 48, is so supported on the frame 3 through a mounting plate 49 by a pin 50 as to turn in a vertical plane and is urged counter-clockwise of FIG. 11 by a spring 51. The manual actuation lever 48 is formed with an engagement pawl 52 at its root, and the front bracket 20 is correspondingly equipped with an engagement member 53 which is projected from the side edge thereof. If the manual actuation lever 48 is manually pushed at its leading end, the engagement pawl 52 lift the engagement member 53 so that the front bracket 20 is separated from the permanent magnet 22. As a result, with the manual actuation levers 43 and 48 of FIGS. 10 and 11, too, the front bracket 20 can be easily dismounted from the front base 19 by a light actuation force of the lever action.

Incidentally, the present invention can also be specified by modifying the shapes and constructions of the individual portions arbitrarily without departing from the gist thereof, as follows:

(1) Suitable changes in the positions for mounting the leaf spring 13, the permanent magnet 22, the threaded pins 12 and 21 and so on;

(2) Use of combination of a coil spring or a torsional spring and a pressure plate in place of the leaf spring 13;

(3) Use of an electromagnet 122 in place of the permanent magnet 22, in this modification, the embroidery frame 4 can be easily dismounted by a lighter force by deenergizing the electromagnet manually or automatically to interrupt the magnetic force; and (4) The number of rear mounting members 9 and front mounting members 18 for mounting the embroidery frame 4 may be other than one.

What is claimed is:

1. An embroidery frame mounting device for an embroidering machine, comprising:

a rear mounting member for mounting a rear portion of the embroidery frame on a frame which is disposed on a table of the embroidering machine; and a front mounting member for mounting a front portion of said embroidery frame on the same frame, wherein said rear mounting member includes a rear bracket mounted on said embroidery frame, a rear positioning unit including a notch having a widened end portion and a pin engaging the notch for positioning said rear bracket transversely with respect to said frame, and a spring for urging and holding said rear bracket on said frame, and wherein said front mounting member includes a front bracket mounted on said embroidery frame, a front positioning unit including a hole and a pin engaging the hole for positioning said front bracket longitudinally and transversely with respect to said frame, and a magnet for attracting and holding said front bracket on said frame.

2. An embroidery frame mounting device as set forth in claim 1, further comprising a rear base fixed on said frame for mounting the rear bracket of said rear mounting member.

3. An embroidery frame mounting device as set forth in claim 1, further comprising a front base fixed on said frame for mounting the front bracket of said front mounting member.

4. An embroidery frame mounting device as set forth in claim 1, wherein said magnet is a permanent magnet.

5. An embroidery frame mounting device as set forth in claim 4, further comprising a manual actuation lever mounted on said front mounting member for removing said front bracket from said frame against the attraction of said permanent magnet.

6. An embroidery frame mounting device as set forth in claim 5, wherein said actuation lever is adapted to turn in a horizontal plane.

7. An embroidery frame mounting device as set forth in claim 5, wherein said actuation lever is adapted to turn in a vertical plane.

8. An embroidery frame mounting device as set forth in claim 1, wherein said magnet is an electromagnet.

9. An embroidery frame mounting device as set forth in claim 1, wherein said spring is a leaf spring having a first end portion supported on said frame, a second end portion of said leaf spring being a free end portion.

10. An embroidery frame mounting device as set forth in claim 9, wherein said second end portion of said leaf spring is sloped so as to receive said rear bracket.

11. An embroidery frame mounting device for an embroidering machine, comprising:

a rear mounting member for mounting a rear portion of the embroidery frame on a frame which is disposed on a table of the embroidering machine;

a front mounting member for mounting a front portion of the embroidery frame on the frame, said rear mounting member including a rear bracket mounted on said embroidery frame, a rear positioning unit for positioning said rear bracket transversely with respect to said frame, and a spring for urging and holding said rear bracket on said frame, said front mounting member including a front bracket mounted on said embroidery frame, a front positioning unit for positioning said front bracket longitudinally and transversely with respect to said frame, and a permanent magnet for attracting and holding said front bracket on said frame; and a manual actuation lever mounted on said front mounting member for removing said front bracket from said frame against the attraction of the permanent magnet.

12. An embroidery frame mounting device as set forth in claim 11, wherein said actuation lever is adapted to turn in a horizontal plane.

13. An embroidery frame mounting device as set forth in claim 11, wherein said actuation lever is adapted to turn in a vertical plane.

* * * * *